US010333244B2

(12) United States Patent
Herbrechtsmeier et al.

(10) Patent No.: US 10,333,244 B2
(45) Date of Patent: Jun. 25, 2019

(54) HOLDING FRAME FOR PLUG CONNECTOR MODULES HAVING A LOCKING BOW THAT CAN BE FASTENED

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/755,024

(22) PCT Filed: Aug. 18, 2016

(86) PCT No.: PCT/DE2016/100375
§ 371 (c)(1),
(2) Date: Feb. 23, 2018

(87) PCT Pub. No.: WO2017/036450
PCT Pub. Date: Mar. 9, 2017

(65) Prior Publication Data

US 2018/0254577 A1 Sep. 6, 2018

(30) Foreign Application Priority Data

Sep. 3, 2015 (DE) ..... 10 2015 114 697

(51) Int. Cl.
*H01R 13/518* (2006.01)
*H01R 13/514* (2006.01)
*H01R 13/512* (2006.01)

(52) U.S. Cl.
CPC ..... *H01R 13/518* (2013.01); *H01R 13/512* (2013.01); *H01R 13/514* (2013.01)

(58) Field of Classification Search
CPC ... H01R 13/518; H01R 13/514; H01R 13/512
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 10176314 A 6/2010
CN 201656162 U 11/2010
(Continued)

OTHER PUBLICATIONS

German Office Action, dated Aug. 10, 2016, for German Application No. 10 2015 114 697.5, 5 pages (no English translation provided).
(Continued)

*Primary Examiner* — Harshad C Patel
(74) *Attorney, Agent, or Firm* — Seed IP Law Group LLP

(57) ABSTRACT

The disclosure relates to a holding frame, into which plug connector modules can be inserted, wherein the holding frame comprises or consists of two halves that can be articulated to each other, a first half and a second half, wherein the holding frame has at least one first locking element and wherein the second half of the holding frame has, at an end face thereof, a pin and the locking element has at least one recess, wherein the pin can engage in the at least one recess and the halves can thereby be fastened in an open position or in a closed position.

11 Claims, 4 Drawing Sheets

Figure 1:
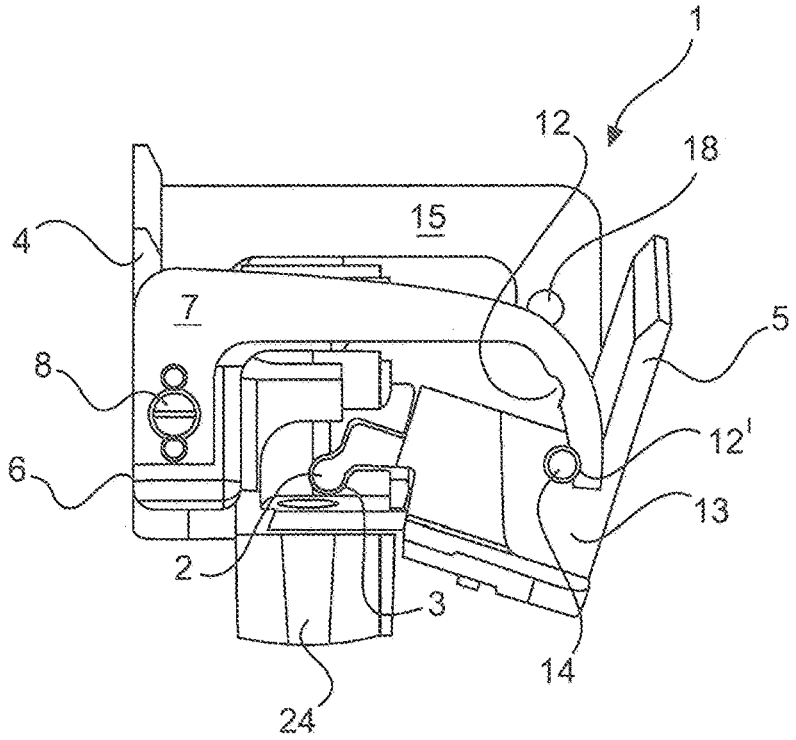

(58) Field of Classification Search
USPC ..... 439/540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A * | 12/1999 | Harting | H01R 13/518 439/532 |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 * | 5/2013 | Feist | H01R 13/512 439/358 |
| 8,668,530 | B2 | 3/2014 | Riepe et al. | |
| 8,821,186 | B2 | 9/2014 | Lan | |
| 8,979,568 | B2 * | 3/2015 | Herbrechtsmeier | H01R 13/62966 439/346 |
| 9,502,813 | B2 | 11/2016 | Dugo | |
| 9,577,365 | B1 * | 2/2017 | Herbrechtsmeier | H01R 13/518 |
| 9,608,374 | B2 | 3/2017 | Beischer et al. | |
| 9,847,608 | B2 | 12/2017 | Bruex et al. | |
| 9,923,307 | B2 | 3/2018 | Beischer et al. | |
| 2005/0070146 | A1 | 3/2005 | Lu | |
| 2006/0035501 | A1 | 2/2006 | Lewis et al. | |
| 2007/0155252 | A1 | 7/2007 | Ferderer | |
| 2010/0159728 | A1 | 6/2010 | Wang et al. | |
| 2014/0179171 | A1 | 6/2014 | Mortun et al. | |
| 2018/0026405 | A1 | 1/2018 | Schlepp et al. | |
| 2018/0241149 | A1 | 8/2018 | Herbrechtsmeier et al. | |
| 2018/0248296 | A1 | 8/2018 | Herbrechtsmeier et al. | |
| 2018/0248297 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254578 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202084755 | U | 12/2011 |
| CN | 20235910 | U | 7/2012 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

International Search Report and Written Opinion, dated Nov. 7, 2016, for International Application No. PCT/DE2016/100375, 11 pages (with English translation of Search Report).
Chinese Office Action, dated Dec. 13, 2018, for Chinese Application No. 201680051302.9, 7 pages (English translation).
Harting Elektronik GmbH, "Schwere Steckverbinder Han-Modular®," Product Catalog, Jan. 1999, 44 pages.
International Preliminary Report on Patentability, dated Mar. 6, 2018, for International Application PCT/DE2016/100375, 16 pages. (with English Translation).
Written Opinion of the International Search Authority, dated Nov. 7, 2016, for International Application No. PCT/DE2016/100375, 7 pages. (English Translation).

* cited by examiner

HOLDING FRAME FOR PLUG CONNECTOR MODULES HAVING A LOCKING BOW THAT CAN BE FASTENED

BACKGROUND

Technical Field

This disclosure relates to a holding frame for plug connector modules.

Holding frames of this type are used to hold plug connector modules, wherein different plug connector modules are fitted into the holding frame and the holding frame is subsequently inserted into the plug connector housing and screwed therein. It is necessary for the holding frame to be mechanically stable so as to be able to withstand the plugging and pulling forces that occur as the plug connection is joined together or separated.

Description of the Related Art DE 197 07 120 C1 discloses a holding frame for plug connector modules. The holding frame comprises two halves that are connected to one another via an articulated joint. Latching hooks of the plug connector modules engage in the recesses of the side faces of the respective halves. The articulated joint or the end-face articulated joints are arranged in the fastening ends of the holding frame. As the holding frame is being screwed onto the fastening face, the frame parts are oriented in such a manner that the side parts of the holding frame are oriented at a right angle with respect to the fastening face. As a consequence, the plug connector modules are fixed in the holding frame.

The holding frame of DE 197 07 120 C1 does not comprise a clearly defined open position for fitting plug connector modules into the holding frame. As a result, the assembly procedure is occasionally somewhat cumbersome, in particular if the persons involved are not experienced.

In order to successfully fit the plug connector modules into the holding frame, it is necessary for said holding frame to be placed in a closed state or in a closed position so that the plug connector modules are fixed. The prior art does not disclose a fixed closed state when referring to the closed state of the holding frame with the result that the holding frame can unintentionally open which can cause the modules to fall out of their anchoring arrangement.

A defined electrical contact between the halves of the holding frame is not always ensured by means of a purely articulated connection. The above described holding frame is therefore unable to reliably assume a grounding function.

CN 204 205 152 U discloses a holding frame that comprises two halves that are connected to one another in an articulated manner. The halves can be moved into an open angular position so as to fit the plug connector modules into the holding frame. It is necessary to work against the force of a spring. The restoring force of the spring pulls the halves 1, 2 back into a closed position after the plug connector modules are fitted.

CN 201 656 162 U discloses a holding frame that comprises two halves that are connected to one another in a linear manner via a spring. The halves can be drawn in a linear manner into an open position so as to fit the plug connector modules into the holding. It is necessary to work against the force of a spring. The restoring force of the spring pulls the halves back into a closed position after the plug connector modules are fitted.

Owing to the fact of having to work against the spring, it is difficult to fit the plug connector modules into the holding frame since on the one hand it is necessary to manually fix the halves and to simultaneously insert the plug connector modules.

DE 20 2012 103 360 U1 discloses a holding frame that comprises two halves that can be latched to one another in two different latching positions by means of displacing one of the frame halves in a linear manner relative to the other frame half. However, as a result of a linearly open holding frame, it is possible for the plug connector modules to fall out as they are fitted into the holding frame.

BRIEF SUMMARY

Embodiments of the present invention provide a holding frame that can be handled in a simple manner and used in a versatile manner.

The holding frame in accordance with an embodiment of the invention is provided so as to receive plug connector modules. Subsequently, the holding frame is installed in a plug connector housing or screwed to a wall face, by way of example of a machine.

The holding frame comprises two halves that can be connected to one another. Each of these halves comprises a side face and an end face. The two halves define a separation plane approximately in their contact region and said separation plane extends in parallel with the longitudinal sides of the halves.

The holding frame comprises the said two halves that can be connected to one another in an articulated manner. As a result of the articulated connection, it is possible to orient the halves at least in two different angular positions with respect to one another. The term 'angular position' is intended to mean that the planes of the individual halves include one angle that changes depending upon the position of the halves.

The second half of the holding frame comprises at the end face a peg and the locking element comprises at least one recess and the peg can engage into the at least one recess. As a consequence, the halves can be fixed in an open position or in a closed position.

Alternatively, the holder frame comprises at least one first locking element which renders it possible to orient and fix the halves in at least two positions with respect to one another. A first position represents the open position and renders it possible to insert the plug connector modules into the holding frame in a simple manner. The term 'open position' is intended to mean that the halves are arranged along the separation line at an angle a that is not equal to 180°. The angle is preferably between 130° to 170°. An angle between 155° and 165° has proven to be particularly advantageous. When the halves are arranged in this angular position, the plug connector modules can be placed in the holding frame in a particularly simple manner. When the halves are in the closed position, they are arranged at an angle of approx. 180° or precisely 180° with respect to one another. In other words, the halves are oriented parallel with one another in the closed position.

A second position represents the closed position. In the closed position, the plug connector modules are held in a reversible manner in the holding frame. The angle a amounts to 180° in this case. The holding frame can be installed in a plug connector housing in a simple manner without the plug connector modules still being able to slide or fall out.

The holding frame can be fixed as desired in an open position or in a closed position.

The holding frame can preferably comprise two locking elements that are arranged on respective end faces of the holding frame.

Furthermore, the halves are connected to one another in an electrically conductive manner via the locking element insofar the locking element and the halves are embodied from an electrically conductive material. The electrically conductive connection is particularly stable if the holding frame is located in the above described closed state.

The locking element is advantageously configured essentially in a U-shape. The locking element covers the end faces of the two halves of the holding frame. As a consequence, the holding frame in accordance with an embodiment of the invention does not have a larger construction than the known holding frames.

The locking element is advantageously a locking metal sheet that is manufactured from a metal material. The metal material renders it possible to produce a conductive connection between the halves of the holding frame.

It is particularly advantageous if the locking element is fixed at one end to one half of the holding frame and at the other end is connected in a non-positive locking manner to the other half of the holding frame. It is also possible to provide a positive/non-positive connection in lieu of a purely non-positive connection. This is explained in detail below.

It is preferred that a peg is provided on at least one half of the holding frame. The locking element comprises at least two associated recesses wherein the peg can engage into the at least two recesses and as a consequence the halves can be oriented and fixed in at least two positions with respect to one another. As an alternative thereto, it is possible to provide at least two pegs at the end face on at least one half of the holding frame and the locking element may comprise merely one recess. The at least two pegs can in each case engage into the recess and as a consequence orient the halves in at least two positions with respect to one another.

It is preferred that in the two described cases the locking element is under stress with the result that a non-positive locking connection is produced. Since the locking element comprises recesses that are in the approximate shape of the peg or of the pegs, there is however in this case also a positive locking connection with the result that it is possible to refer overall to a non-positive and simultaneously positive locking connection.

In an advantageous manner, the peg or the pegs is/are configured in a cylindrical shape. The cylindrical shape renders it possible to slide the locking element in a simple manner over the peg or pegs.

It is preferred that the holding frame comprises articulated joints that connect the halves to one another in an articulated manner. Such an articulated connection has proven itself to be reliable as is apparent from the above mentioned prior art.

The articulated connection of the two halves of the holding frame renders it possible to orient the two halves. The locking element renders it possible to provide the fixing arrangement. The holding frame is particularly user-friendly as a result of the interaction between the articulated connection and the fact that the holding frame can be fixed in two positions.

In a particularly advantageous embodiment of the invention, the holding frame comprises a second locking element, wherein the second locking element is fixed at one end to the first half of the holding frame and at the other end is connected in a positive locking manner to the second half of the holding frame. The positive locking connection can be released by moving the second locking element away from an end face of the second half. If the locking element is pushed in an axial direction away from the end face of one half, the locking element is released from the positive locking connection. As a consequence, the two halves can be moved at least into two different positions with respect to one another.

It is advantageously possible for the holding frame to also comprise two second locking elements that are located on the respective end faces of the holding frame.

In order to ensure that the second locking element can provide the fixing arrangement, the second locking element comprises at least two holes and an allocated half comprises at least one peg, wherein the peg can engage into the at least two holes. If the peg is positioned in the hole of the locking element that is located in the upper region of the U-shaped curve, the holding frame is located in an open position in which it is possible to fit the plug connector modules. If the peg is located in a hole in the lower region of the U-shaped curve of the locking element, the holding frame is located in a closed position. In this closed position, the plug connector modules can no longer fall out or slide out of the holding frame.

As an alternative thereto, the second locking element may comprise only one hole and the allocated half comprises at least two pegs, wherein the pegs can engage into the hole. This solution also renders it possible to fix the holding frame in an open position and a closed position.

The two halves of the holding frame are advantageously produced from a metal material. When the holding frame is in a closed state, the halves are in electrical conductive contact with one another. The above mentioned articulated connection may not be sufficient to achieve a defined electrical contact between the holding frames. The two halves are placed in electrical contact with one another via the locking element. This occurs on the one hand via the locking element itself insofar as it is manufactured from an electrical conductive material. Furthermore, as a result of the locking element being pre-stressed, the articulated joint head of one half is pushed into the articulated joint receiving arrangement of the other half, wherein a reliable electrical contact is produced.

In the case of the current disclosure, the terms 'open or closed state' and 'open or closed position' are used synonymously.

EXEMPLARY EMBODIMENT

Figure 2:
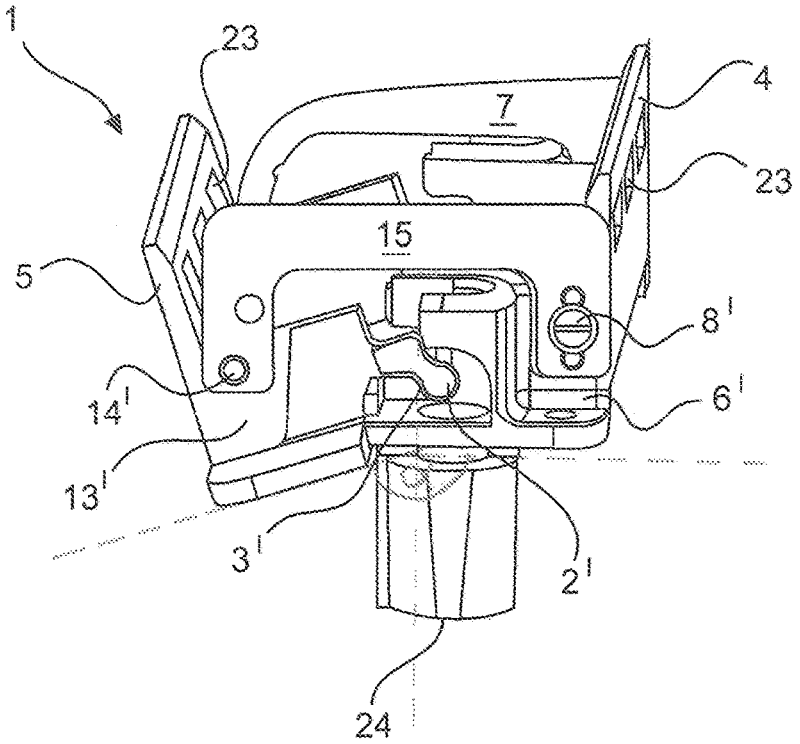
Figure 3:
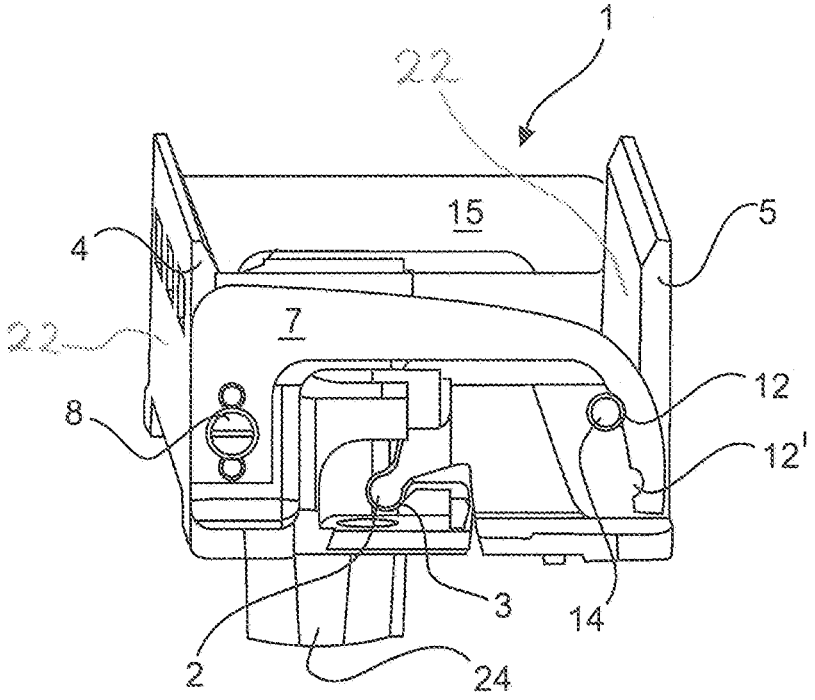
Figure 4:
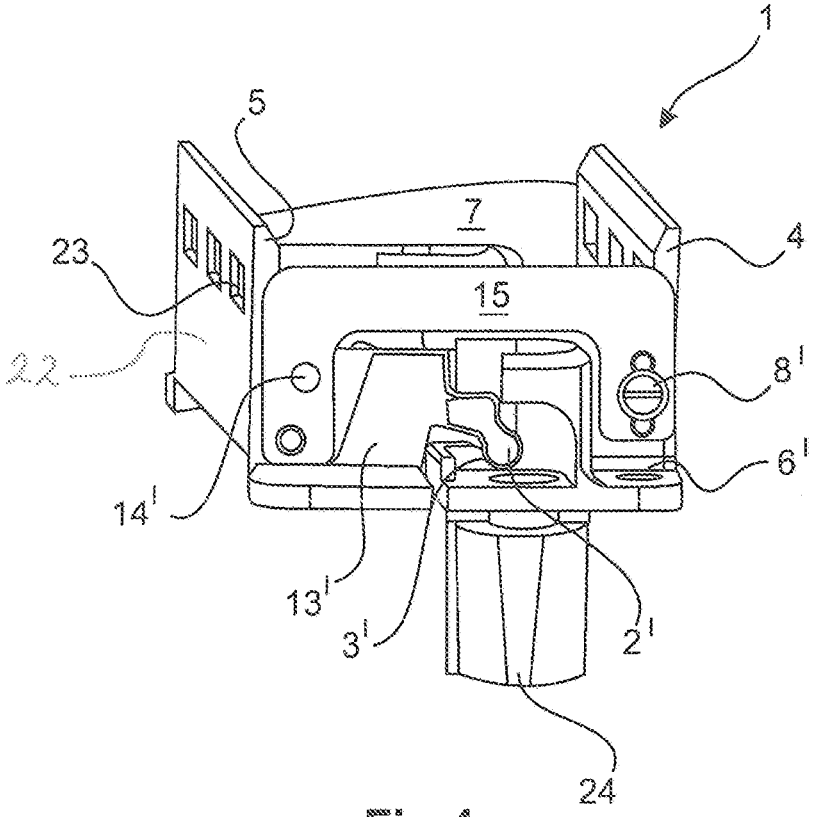
Figure 5:
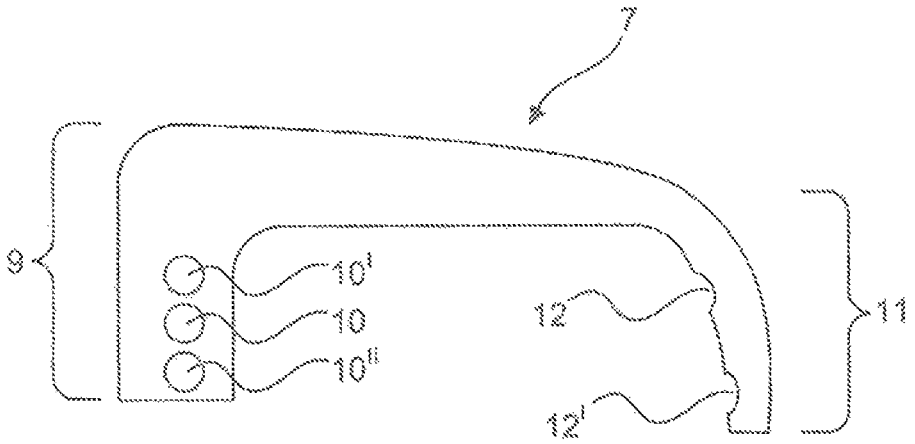
Figure 6:
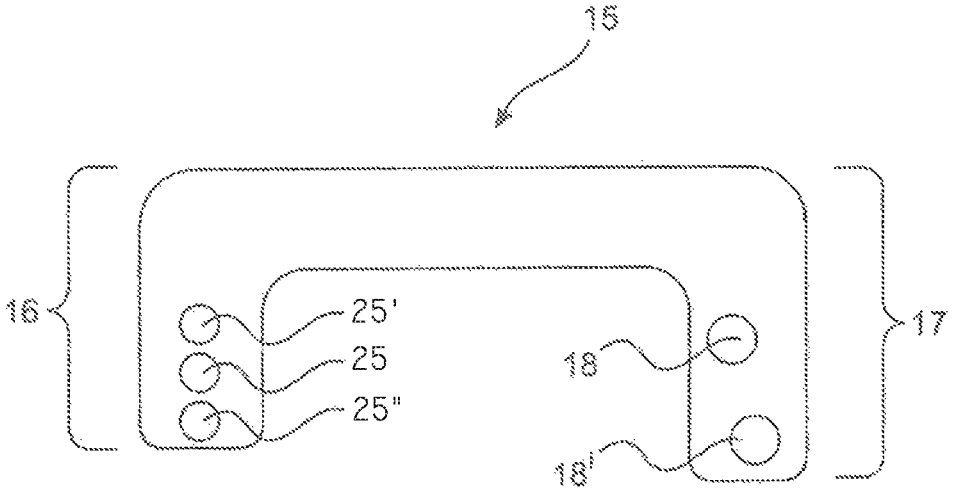
Figure 7:
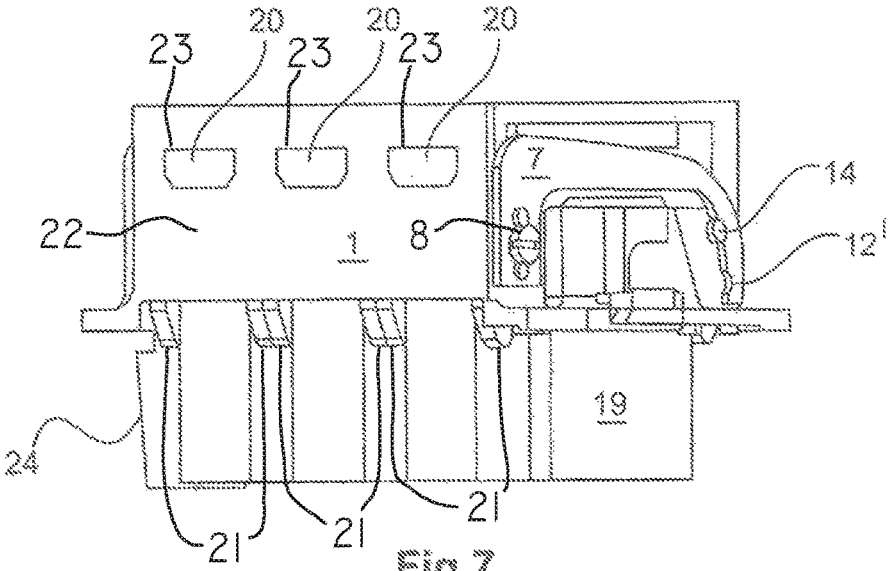
Figure 8:
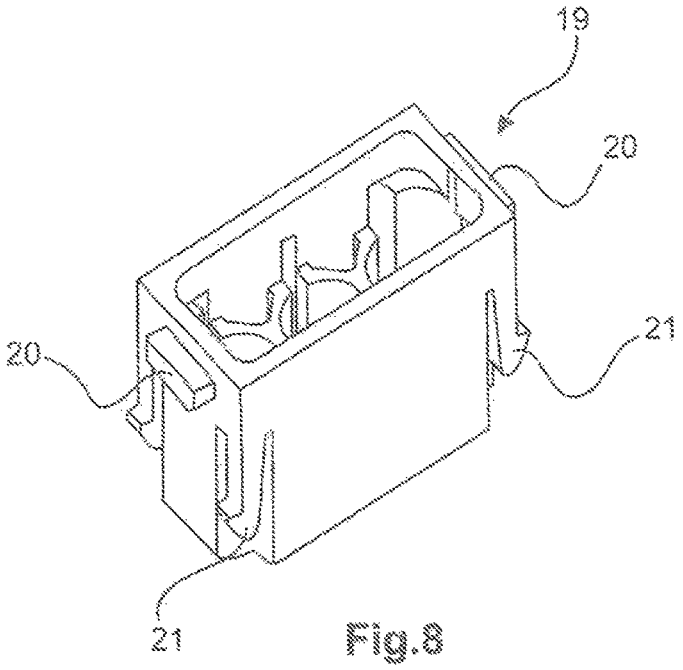

An exemplary embodiment of the invention is illustrated in the drawings and is explained in detail below. In the drawings:

FIG. 1 illustrates a perspective view of a holding frame with a first locking element in the open position, FIG. 2 illustrates a further perspective view of the holding frame with a second locking element in the open position, FIG. 3 illustrates a further perspective view of the holding frame with the first locking element in the closed position, FIG. 4 illustrates a further perspective view of the holding frame with the second locking element in the closed position, FIG. 5 illustrates a plan view of a locking element, FIG. 6 illustrates a plan view of a further locking element, FIG. 7 illustrates a perspective view of a holding frame with the plug connector modules fitted in place and with a first locking element and FIG. 8 illustrates a perspective view of a plug connector module.

The figures show in part simplified, schematic illustrations. In part, identical reference numerals are used for similar but possibly not identical elements. Different views of the similar elements can be scaled differently.

DETAILED DESCRIPTION

FIG. 1 illustrates a holding frame 1 in an open position. In the open position, the side parts 22 of the respective halves 4, 5 are no longer oriented in a parallel manner with respect to one another. The holding frame comprises essentially two halves 4, 5 that are connected to one another via an articulated joint. For this purpose, one half 5 comprises on respective end faces an articulated joint head 2 that engages in an articulated joint receiving arrangement 3 that is provided for this purpose on the opposite-lying half 4. This is referred to in this case as an articulated connection of the two halves 4, 5 of the holding frame 1.

A locking element 7 is fixed to an end face 6 of one half 4 of the holding frame 1. The fixing arrangement is realized by way of example via a screw 8. A rivet connection would also be possible. However, by virtue of a screw connection the locking element 7 could be subsequently replaced in a simple manner if the functionality becomes impaired.

With reference to FIGS. 1, 3 and 5, the locking element 7 comprises essentially a U-shape. A first limb 9 of the locking element 7 is fastened to the end face 6 of the half 4. For this purpose, the first limb 9 comprises corresponding openings 10, 10', 10". The opposite-lying second limb 11 of the locking element 7 comprises two recesses 12, 12'.

With reference to FIG. 1, a peg 14 that is essentially cylindrical in shape is formed on an end face 13 of the other half 5 of the holding frame 1. If the peg 14 engages in a first recess 12' of the locking element 7, the holding frame 1 is located in the open position.

According to the illustrated embodiment, the opposite-lying end faces 6', 13' of the halves 4, 5 are covered by a second locking element 15 having a different form factor. As an alternative, the end faces 6', 13' could also be covered by a locking element 7 in precisely the same manner as the other end faces 6, 13. Such an embodiment is easily conceivable and is therefore not further illustrated in the figures. If a second locking element 15 is provided, the locking element 7 referred to herein may be referred to as a first locking element 7.

With reference to FIGS. 2, 4 and 6, a first limb 16 of the second locking element 15 is fastened to the first end face 6' of one half 4 of the holding frame 1 essentially via openings 25, 25', 25" in combination with a screw 8'. A second limb 17 of the second locking element 15 is fixed in a positive locking manner to the second end face 13' of the opposite-lying half 5. For this purpose, the second limb 17 of the second locking element 15 comprises two openings 18, 18' into which a peg 14' of the second end face 13' of the opposite-lying halves 5 can engage. If the peg 14' is located in the opening 18' at the end of the second limb 17 of the second locking element 15, the holding frame 1 is already located in the open position for receiving the plug connector modules, as shown in FIG. 2. If the peg 14 is located in the opening 18 that is further away from the end, the holding frame 1 is located in the closed position, as shown in FIG. 4.

The holding frame 1 illustrated in the figures functions with a first locking element 7 that connects or fixes the halves 4, 5 in an essentially non-positive locking manner, whereas a second locking element 15 connects or fixes the halves 4, 5 in an essentially positive locking manner on the opposite-lying side. The second locking element 15 can be released from the engagement with the peg 14' by pushing away the second limb 17 of the second locking element 15 from the second end face 13' and said second locking element 15 is consequently released from the positive locking fixing arrangement. It is possible by virtue of moving the halves 4, 5 towards one another for the peg 14' to be brought into engagement with the respective other opening 18 or 18', as a result of which the above mentioned open or closed position of the holding frame 1 is achieved. The opposite-lying locking element 7 is brought into engagement with the peg 14 in each case as the halves 4, 5 are moved towards one another. The recesses 12 or 12' engage with the peg 14 in a similar manner. The first locking element 7 is slightly stressed, in other words the limb 11 of the first locking element 7 exerts a force in the direction of the other limb 9 on the peg 14. As a result, a fixing arrangement is achieved in a non-positive or essentially non-positive manner.

The holding frame 1 is generally delivered to the client in the closed position. The customer pushes the second locking element 15 in the axial direction away from the holding frame 1 and moves the halves into an open position until the first locking element 7 latches in the open position and the second locking element 15 fixes the holding frame 1 simultaneously in the open position. This positive locking fixing arrangement provided by the second locking element 15 is particularly secure. The holding frame 1 remains in the respective position in a reliable manner.

It could also be expedient to deliver the holding frame 1 in an open position. The customer can then immediately start to fit the plug connector modules 19 (FIGS. 7 and 8).

The open position of the holding frame 1 is illustrated in FIGS. 1 and 2. The closed position of the holding frame 1 is illustrated in FIGS. 3 and 4.

The term 'open position' is intended to mean that the halves are arranged with respect to one another along the separation line at an angle a not equal to 180°. The angle is preferably between 130° to 170°. An angle between 155° and 165° has proven itself to be particularly advantageous. The plug connector modules can be placed in the holding frame in a particularly simple manner when the halves are located in this angular position. When the halves are in the closed position, they assume an angle of approx. 180° or precisely 180° with respect to one another. The halves are therefore parallel with one another when they are in the closed position.

Plug connector modules 19 have been known for a long time and are described by way of example in DE 197 07 120 C1. The plug connector modules 19 are provided with protruding, slightly rectangular holding means 20 and spring-elastic latching hooks 21. Recesses 23 that are formed as openings that are closed on all sides are provided in the side parts 22 of the halves 4, 5 and the holding means 20 fit into said recesses as the plug connector modules 19 are inserted into the holding frame 1.

In order to insert the plug connector modules 19, the holding frame 1 is moved into an open position as described above with the result that the plug connector modules 19 can be inserted. So as to pre-fix the plug connector modules 19, the latching hooks 21 initially engage under the lower edges of the side parts 22 of the halves 4, 5 during the insertion procedure.

The frame halves 4, 5 are subsequently moved as described above into a closed position, wherein the holding means 20 move into the recesses 23 and the plug connector modules 19 are held in the holding frame 1 in a secure, positive locking manner.

The holding frame 1 comprises a grounding bushing 24 and a pin (not illustrated) of the opposite-lying holding frame can engage in said grounding bushing.

FIG. 7 illustrates the holding frame 1 in a closed position with the plug connector modules 19 received therein. The side parts 22 of the halves are oriented generally parallel with one another.

To reiterate, an embodiment of the present invention relates to a holding frame (1) into which it is possible to insert plug connector modules (19), wherein the holding frame (1) comprises two halves (4, 5) that can be connected to one another, wherein the holding frames (1) comprise at least one locking element (7) and wherein the halves (4, 5) can be oriented and fixed in at least two positions with respect to one another via the locking element (7). The locking element (7) is fixed at one end to one half (4) of the holding frame (1) and at the other end is connected in a non-positive locking manner to the other half (5) of the holding frame (1). The holding frame (1) may comprise a second locking element (15), wherein the second locking element (15) is fixed at one end to the first half (4) of the holding frame (1) and at the other end is connected in a positive locking manner to the second half (5) of the holding frame (1) and wherein the positive locking connection can be released by moving the second locking element (15) that faces in the axial direction away from an end face of the second half (5).

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame adapted to receive plug connector modules, wherein the holding frame comprises:

two halves, a first half and a second half, which are connected to one another in an articulated manner via articulated joints, the second half of the holding frame comprising a peg at an end face thereof; and at least one locking element comprising an elongate body having a first end and a second end opposite the first end, the first end of the elongate body of the locking element being coupled to the first half of the holding frame at a location remote from the articulated joints, and the second end of the elongate body of the locking element including at least one recess, and wherein the peg is adapted to engage in the at least one recess at the second end of the elongate body of the locking element and as a consequence of which the two halves of the holding frame can be fixed in an open position or in a closed position.

2. The holding frame as claimed in claim 1, wherein the locking element is configured essentially in a U-shape.

3. The holding frame as claimed in claim 1, wherein the locking element is fixed at the first end of the elongate body to the first half of the holding frame and the second end of the elongate body is connected in a positive locking and/or non-positive locking manner to the second half of the holding frame.

4. The holding frame as claimed in claim 1, wherein:

the second end of the elongate body of the locking element comprises at least two recesses, wherein the peg is adapted to engage into the at least two recesses and as a consequence of which the two halves of the holding frame can be fixed in the open position as well as in the closed position; or the second half comprises at the end face at least two pegs and the locking element comprises a single recess at the second end of the elongate body, wherein the at least two pegs are adapted to engage in each case into the single recess and as a consequence of which the two halves of the holding frame can be fixed in the open position as well as in the closed position.

5. The holding frame as claimed in claim 4, wherein the peg or the pegs are configured in a cylindrical shape.

6. The holding frame as claimed in claim 1, wherein the holding frame comprises a second locking element comprising an elongate body having a first end and a second end opposite the first end, wherein the second locking element is fixed at the first end of the elongate body to the first half of the holding frame and the second end of the elongate body is connected in a positive locking manner to the second half of the holding frame, and wherein the positive locking connection can be released by moving the second locking element in an axial direction away from an end face of the second half of the holding frame.

7. The holding frame as claimed in claim 6, wherein:

the second end of the elongate body of the second locking element comprises at least two openings and the second half of the holding frame comprises at least one corresponding peg, and wherein the at least one corresponding peg is adapted to engage into the at least two openings; or the second end of the elongate body of the second locking element comprises a single opening and the second half comprises at least two corresponding pegs, wherein the at least two corresponding pegs are adapted to engage into the single opening.

8. The holding frame as claimed in claim 1, wherein the locking element is manufactured from a metal material.

9. The holding frame as claimed in claim 1, wherein the halves are embodied from a metal material and in the closed position the halves are in contact with one another in an electrical conductive manner.

10. The holding frame as claimed in claim 1, wherein the locking element is distinct from and removably coupled to the two halves of the holding frame.

11. The holding frame as claims in claim 1, wherein the locking element is bow-shaped and extends between the two halves of the holding frame and around the articulated joints.

* * * * *